US006869251B2

(12) United States Patent
Zou et al.

(10) Patent No.: US 6,869,251 B2
(45) **Date of Patent: *Mar. 22, 2005**

(54) MARINE BUOY FOR OFFSHORE SUPPORT

(75) Inventors: Jun Zou, Katy, TX (US); Edward Huang, Houston, TX (US); Clay F. Anderson, Katy, TX (US); John Allen, Houston, TX (US)

(73) Assignee: ABB Lummus Global, Inc., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/094,735

(22) Filed: Mar. 11, 2002

(65) Prior Publication Data

US 2002/0197116 A1 Dec. 26, 2002

Related U.S. Application Data

(63) Continuation-in-part of application No. 09/303,078, filed on Apr. 30, 1999, now Pat. No. 6,371,697.

(51) Int. Cl.[7] ..... B63B 35/44

(52) U.S. Cl. ..... 405/205; 405/207; 405/210; 405/224; 405/200; 114/264; 114/256

(58) Field of Search ..... 405/195.1, 196, 405/200, 203, 207, 205, 219, 223.1, 227, 227.2, 224; 114/256, 264, 265, 260

(56) References Cited

U.S. PATENT DOCUMENTS 3,472,032 A 10/1969 Howard
3,709,307 A * 1/1973 Clark ..... 114/264
3,717,113 A * 2/1973 Wilde ..... 114/264
3,771,481 A 11/1973 Goren et al
3,824,795 A 7/1974 Mo
3,879,952 A 4/1975 Mo
4,043,138 A 8/1977 Stageboe et al.
4,060,995 A 12/1977 Lacroix et al.
4,168,556 A * 9/1979 Fink et al. ..... 114/264
4,473,323 A 9/1984 Gregory
4,502,551 A * 3/1985 Rule et al. ..... 114/264
4,606,673 A * 8/1986 Daniell ..... 405/210
4,626,137 A * 12/1986 Willemsz ..... 405/224
4,702,321 A 10/1987 Horton
5,381,865 A * 1/1995 Blandford ..... 166/344
5,567,086 A * 10/1996 Huete ..... 405/223.1
5,609,442 A * 3/1997 Horton ..... 405/205
6,371,697 B2 * 4/2002 Huang et al. ..... 405/224.2

* cited by examiner

*Primary Examiner*—Frederick L. Lagman
(74) *Attorney, Agent, or Firm*—Bracewell & Patterson, L.L.P.

(57) ABSTRACT

A marine buoy for the offshore support of subsea production and drilling activities that has a closed-bottomed base section with a solid ballast and variable ballast chambers, a chamber in the base section for storing equipment and supplies, and an upper section with a smaller cross-sectional area than the base section having an elevator shaft leading from the top of the upper section to the chamber in the base section. The upper section supports a deck for housing process equipment for operations that the marine buoy is supporting.

22 Claims, 4 Drawing Sheets

MARINE BUOY FOR OFFSHORE SUPPORT

This application is a continuation-in-part of U.S. application Ser. No. 09/303,078, filed Apr. 30, 1999 now U.S. Pat. No. 6,371,697.

BACKGROUND OF THE INVENTION

1. Field of the Invention

The invention relates generally to floating vessels used for supporting offshore drilling operations.

2. Description of the Related Art

Petroleum production often requires the placement of a rig in an offshore location. In shallow waters, the rigs and production facilities can be placed on freestanding offshore platforms. As the water becomes deeper, however, these become impractical, and it is necessary to have a floating platform, or support vessel, upon which the rigs and production facilities can be placed.

One type of deepwater support vessel is the tension leg platform (TLP). The TLP is a buoyant platform that is secured to the seabed using generally vertically-oriented rigid tethers or rods that restrain the platform against vertical and horizontal motion relative to the well in the seabed below. Thus, these platforms have a very short period in response to wave action.

An alternative to the TLP is the deep draft caisson vessel (DDCV). The DDCV is a free floating vessel which is moored to the seabed using flexible tethers so that the vertical and horizontal motion of the vessel is restrained, although not eliminated. Examples of DDCVs are found in U.S. Pat. No. 4,803,321.

Methods for restraining the DDCVs attempt to slow, rather than eliminate, the natural response period of the vessel to wave effects. Current DDCV arrangements "decouple" the vessel from the individual wells being supported so that the wells are not subject to the same induced motions as the vessel. Decoupling is typically accomplished by using buoyant means to make the wells separately freestanding and using flexible hoses to interconnect the vertical risers from the well to the production facilities.

A common variety of DDCV is the type shown in U.S. Pat. No. 4,702,321 that utilizes a long cylindrical structure and is commonly known as a spar. When the vessel is in its installed position, the cylindrical structure exhibits very slow pitch surge and heave motions. Heave motion, however, is not totally eliminated, allowing the structure to bob up and down vertically in the sea. Attempts have been made to add a number of horizontally extending plates along the length of the spar to help the spar be more resistant to heave.

Even with the plates, the spar must be assembled and transported in a horizontal position and then installed by being upended at or near the final site using a large crane that must also be transported to the installation site. As these caisson structures are often around 650 ft. in length, transporting and upending of the structure are risky. Further, it is only after successfully upending and mooring of the structure that components of the rig can be placed atop the spar.

Recently a floating vessel which provides reduced motions and slow natural response periods to heave, but can also be assembled and transported in a vertical, or upright, orientation has been developed. A vessel of this type permits rig components to be placed atop the vessel prior to or during transport.

What is needed is a vessel which can act as a support vehicle for drilling operations on one of these newly developed drilling platforms. There is a necessity for a support vessel that can generate energy and provide extra storage for these new deep-sea drilling vessels, while also providing the same or comparable reduced motions and slow natural response periods to heave, and that can also be assembled and transported in a vertical, or upright, orientation. A vessel of this type permits supplies and equipment to be placed atop and inside the storage areas of the vessel prior to or during transport.

SUMMARY OF THE INVENTION

The present invention provides an improved marine buoy for offshore support of subsea drilling operations that is capable of being moored by tethers to the sea floor, as well as a process for supporting subsea drilling activities. The marine buoy has a fully enclosed lower base section, an upper section affixed to the lower base section with a smaller cross-sectional area than the lower base section, and an elevator shaft with an elevator running from the top of the upper section to the lower base section.

The floor of the lower base section is a solid ballast throughout the entire cross-section of the lower base section. The lower base section also contains ballast tanks that may be filled to help lower the lower base section and part of the upper section under the waterline. Water is the ballast for variable ballast chambers. Solids like magnetite or ballastcrete are the ballast for fixed ballast chambers. The ballast tanks can also be emptied of ballast to help raise the marine buoy in the water so that part of the lower base section is above the waterline.

The upper section contains voids between the outer surface and the wall of the elevator shaft that are compartmentalized into different levels. At least one of these compartments is another ballast chamber that can be filled with air or ballast to help the buoy raise or lower itself in the water. Some of the compartments toward the top of the upper section may be used as rooms for instrumentation, controls, and energy generation. Some of the compartments further down in the upper section may be used as storage for equipment or chemicals and their pumps.

The elevator shaft and the elevator extend the vertical center of the upper base section. The elevator is used to transport equipment, personnel, and supplies to and from the deck to the different levels of the buoy.

At the base of the elevator shaft is the pump room in which water pumps are used to control the water levels in the lower base section and the upper section ballast chambers. One or more supports are provided which assist in securing the riser and absorbing energy from movement of the platform.

The marine buoy can be constructed and transported in an upright, or vertical, orientation so that it does not need to be upended prior to mooring at its intended location. In addition, structures such as a crane and its pedestal may be placed atop the deck prior to or during transportation of the vessel. During transportation by towing, the floatation tanks of the upper and lower base sections are filled with air so that the lower base section is partially raised above the surface of the water. The marine buoy is placed into its installed position by inserting water ballast into the variable ballast chambers in the upper and lower base section ballast chambers to cause the lower base section to become submerged.

DETAILED DESCRIPTION OF THE PREFERRED EMBODIMENTS

Figure 1:
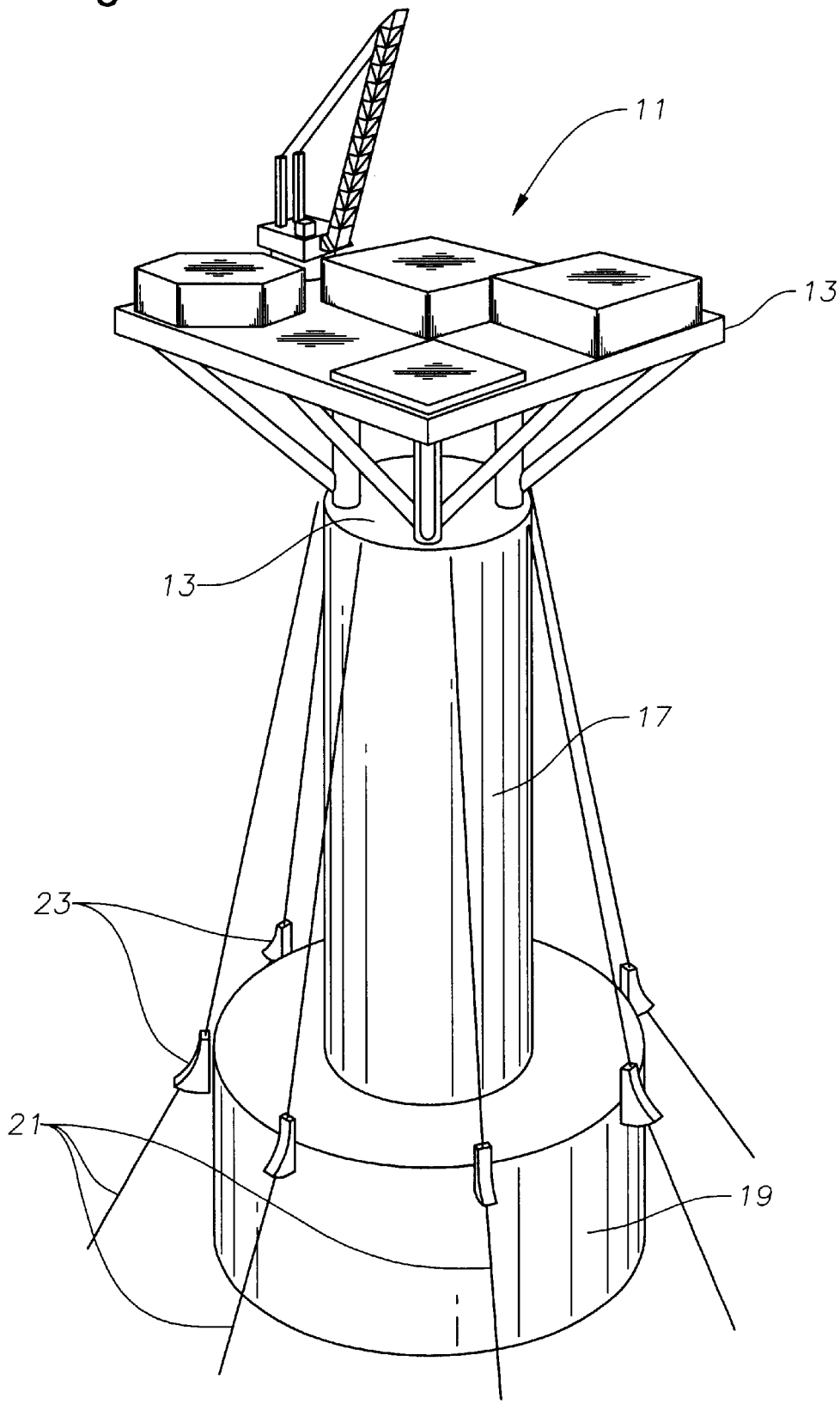
FIG. 1 is a perspective view of an exemplary marine buoy constructed in accordance with the present invention.
Figure 2:
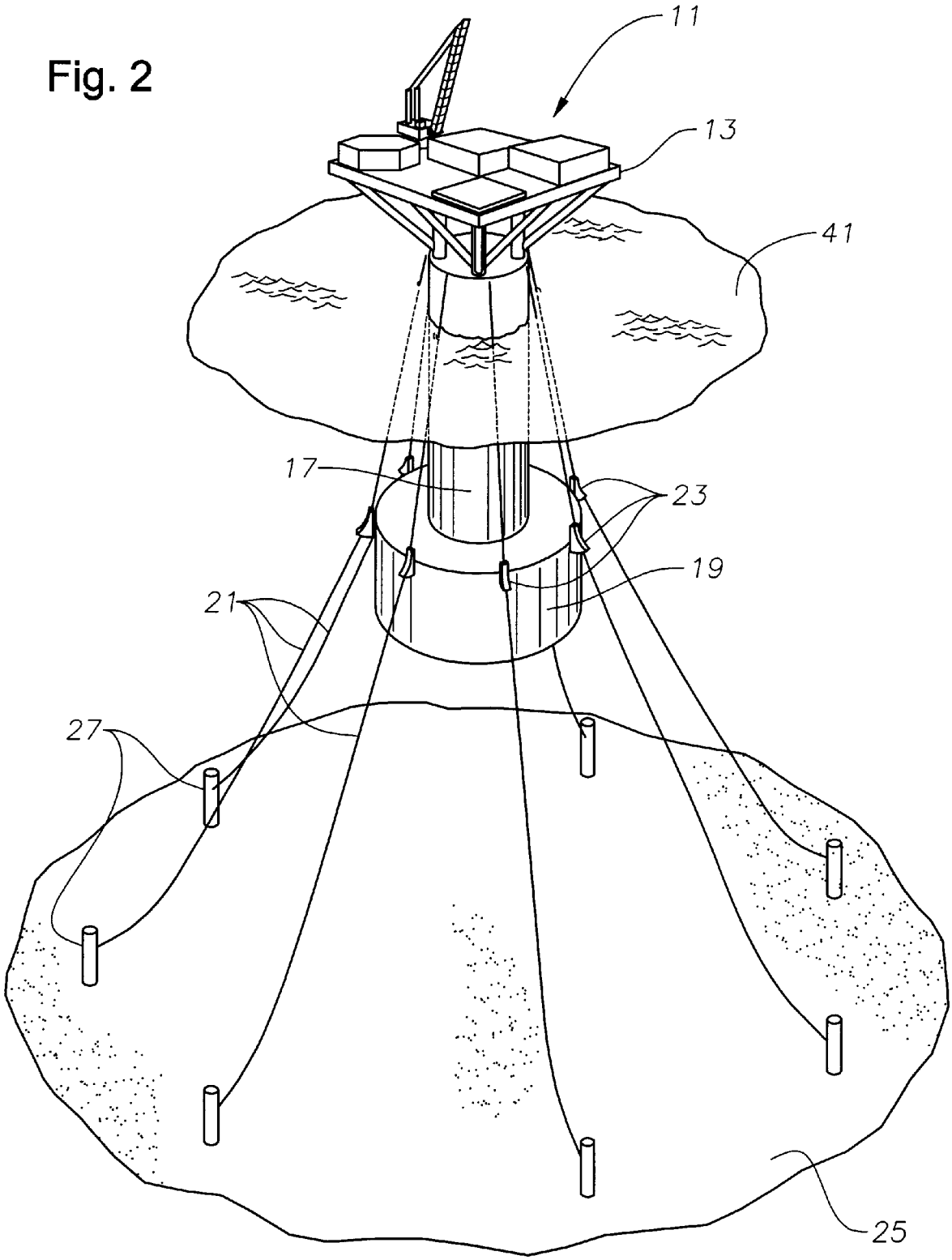
FIG. 2 is a schematic drawing showing a marine buoy constructed in accordance with the present invention being moored to the sea floor.

FIGS. 1–2 depict a marine buoy 11 for the support of offshore, subsea drilling operations that is capable of being moored by tethers to the sea floor. The deck 13 of the marine buoy may have constructed upon it power generation equipment, communications and controls equipment, one or more cranes for transferring materials, and other devices and facilities used for supporting the drilling and for production of oil and gas.

Marine buoy 11 has an outer hull 15 and is primarily made up of an upper section 14 and a lower base section 19. Upper base section 17 supports deck 13, upon which the crane, communications equipment, and power generation equipment are secured. Lower base section 19 preferably has a double wall to reduce the risk of leakage in the event of a collision. As shown in FIGS. 1–2, a plurality of mooring lines 21 are secured near the upper end of upper base section 17. The mooring lines 21 extend through bending shoes 23 on lower base section 19 and are then secured in a manner known in the art to sea floor 25 by anchors 27. It is noted that bending shoes 23 are located upon the diametrical exterior of lower base section 19. As a result, marine buoy 11 is held in a more stable manner by mooring lines 21.

Upper section 17 has a cross-sectional area that is smaller than the cross-sectional area of lower base section 19. In a presently preferred embodiment, upper section 17 is substantially cylindrical, and the cross-sectional area of upper section 17 in one embodiment is based upon a diameter of between 23 feet to 31 feet. Similarly, lower base section 19 is also substantially cylindrical, and the cross-sectional area is based upon a diameter between 56 feet to 74 feet. The height of lower base section 19 is less that the height of upper section 17, preferably about one third. Overall height from the bottom of lower base section 19 to deck 13 may be in the range from 150–200 feet. It should be noted, these dimensions are not intended to be limiting and other dimensions may be used as required by the sea conditions and equipment to be supported.

Figure 3:
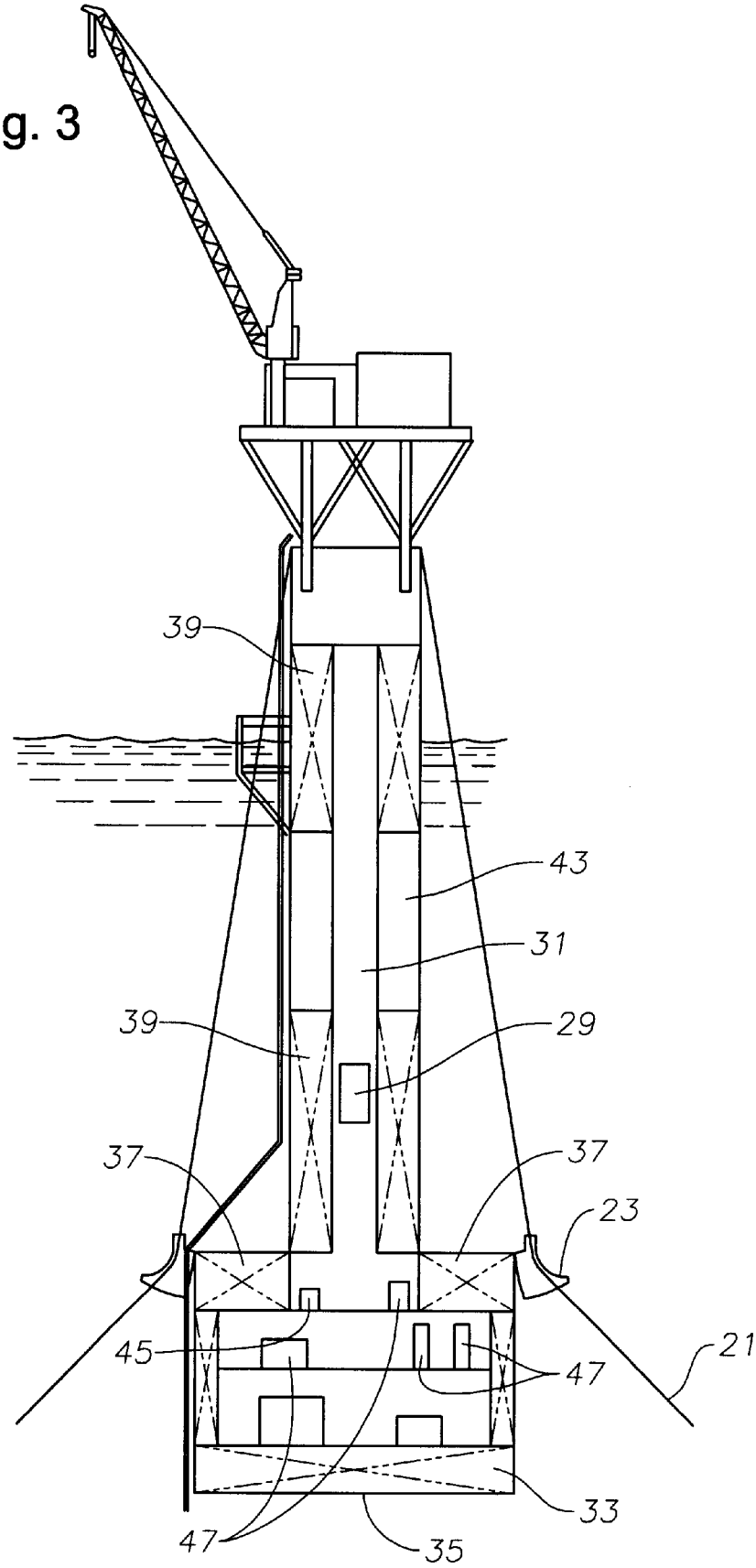
FIG. 3 is a cross-sectional view of the marine buoy shown in FIGS. 1 and 2.

Referring to FIG. 3, an elevator 29 within an elevator shaft chamber 31 can be seen to be defined centrally within marine buoy 11. Lower base section 19 of marine buoy 11 contains a solid weight ballast 33 horizontally distributed in an even manner along its lower floor 35. The horizontal distribution of weighted ballast 33 provides added mass moment of inertia which serves to reduce pitch motions. Weighted ballast 33 preferably comprises iron ore ballast, although other ballast suitable for weighting the structure, like magnetite or ballastcrete, can be used.

Lower base section ballast chambers 37 are located above weighted ballast 33 in lower base section 19. Lower ballast chambers 37 are provided with fittings or valves (not shown) which permit the tanks to be filled with air or, if desired, or completely filling with ballast in order to lower the lower base section 19 below the waterline 41.

In the preferred embodiment, upper section 17 of the marine buoy also include at least one upper ballast chamber 39 along its compartmentalized length. Ballast chambers 39 in upper section 17 are preferably variable pressure tanks with fittings (not shown) which permit the ballast chambers to be partially filled with ballast and partially filled with air so that the amount of buoyancy provided by ballast chambers 37, and 39 is adjustable.

The elongated shape of upper section 17 ensures that marine buoy 11 is stable and resists pitch and roll forces. Further, the fact that upper section 17 presents a reduced cross-sectional area, there is a limited effective area that is exposed to wave action at or near the surface 41 of the water. Although upper section 17 has an elongated shape, its length can be shorter than that of a standard spar due to the presence of the diametrically enlarged base section 19.

The radial enlargement of the lower base section 19 provides resistance to heave so that marine buoy 11 has a low heave response. When placed in its installed configuration, marine buoy 11 has a draft of about 160 feet, or less in the preferred embodiment.

FIG. 1 shows deck 13 located above upper section 17, the structure and operation of which are better understood by references to FIG. 3. The preferred placement of equipment either on deck 13 or in the hull 15 is based upon the type of equipment or supplies. The overall approach is to locate all marine, process control and communication equipment inside lower base section 19 of hull 15 with the exception of any equipment where hydrocarbons may be present. Further, equipment requiring access and maintenance, such as control panels and rotating equipment, are located on the deck 13, or as close to the top of hull 15 as possible.

Upper base section 17 has more than one level in the preferred embodiment, each having compartments 43 for equipment such as pumps 45, power generation, and control equipment. Also storage areas are preferably provided in upper section 17 for chemicals used in well production. The pump equipment 45 delivers the chemicals to the well. The pump equipment is used also to pump out ballast water.

Figure 4:
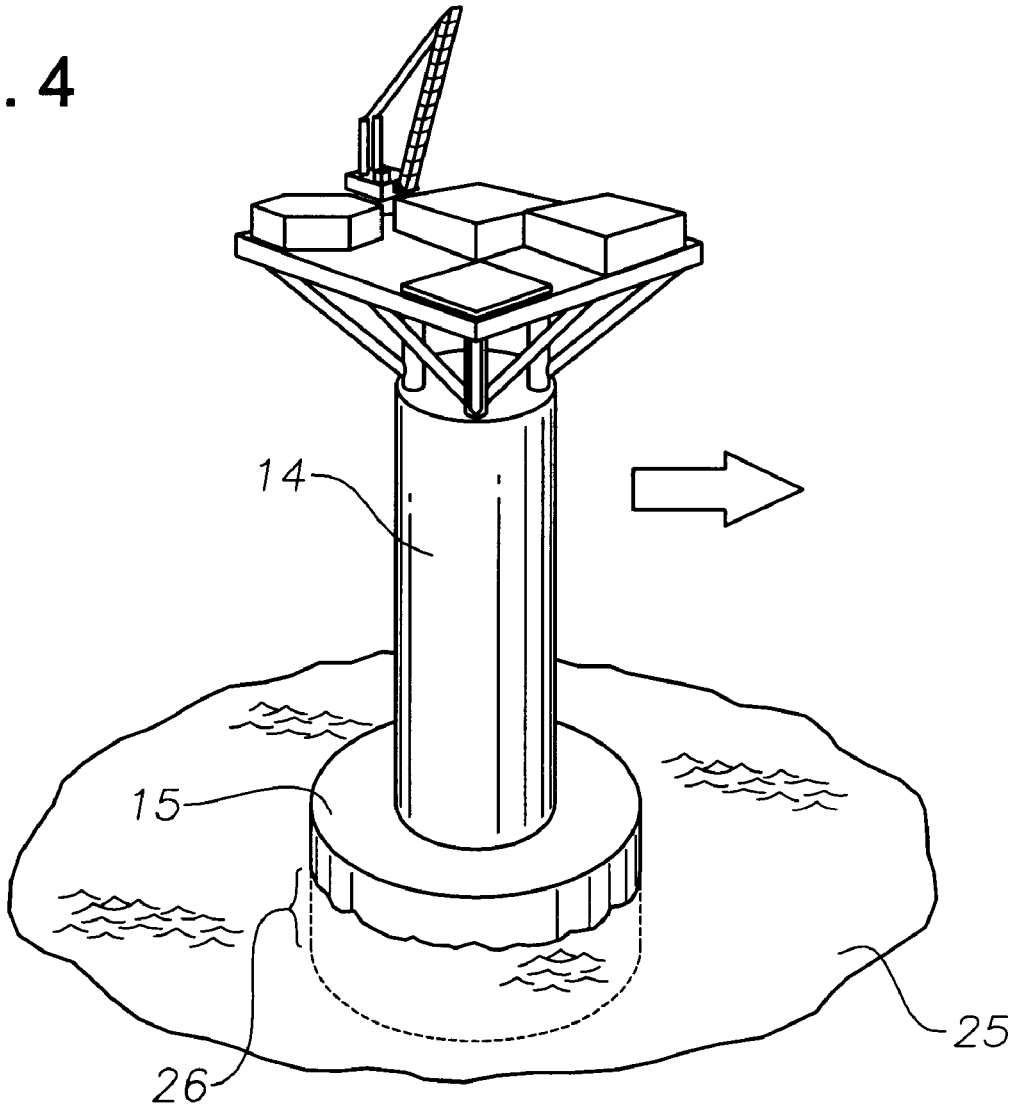
FIG. 4 depicts the arrangement of the marine buoy during transportation by towing.

In operation, marine buoy 11 is capable of being converted between a towing, or transport, configuration and an installed configuration. The towing configuration is illustrated by FIG. 4 which shows marine buoy 11 disposed within the sea so that upper section 14 and a portion of lower base section 15 are located above waterline 25. A submerged portion 26 of lower base 15 section resides below waterline 25. The towing configuration is achieved by emptying lower base section floatation ballast chambers 23 and upper base section ballast chambers 24 so that marine buoy 11 is raised within the water substantially as shown in FIG. 4.

Marine buoy 11 is moveable by direct towing in the upright, transport configuration by tugboats or other vessels (not shown). The draft may be about 25 feet while towing. Marine buoy 11 may also be placed aboard a barge (not shown) for transport.

When the marine buoy 11 is located at the location where it is desired to be installed, lower ballast chambers 23 and upper ballast chambers 24 (as needed) are filled with water. The addition of the ballast causes lower base section 15 and part of upper section 14 to become disposed beneath water surface 25, as depicted in FIGS. 2–3. When in this installed position, marine buoy 11 has a draft of about 160 feet, or less.

In the installed position, marine buoy 11 provides a stable support station that provides controlled harmonic responses to the dynamic loads of its environment produced by waves and swells in the sea, as will be apparent those skilled in the art. Electrical power may be generated onboard, but is preferably delivered by a cable from a remote host platform. This reduces the need to store fuel and power generation equipment.

Supplies such as chemicals for well treating may be delivered and stored in compartments 43. Personnel can access pumps 45 and the pumping equipment 47 via elevator 29. In one use, the installed position may be a considerable distance from a main production platform. For example, it could be near outlying wells and used for storing and delivering various chemicals to producing wells. This avoids having to transport chemicals over large distances from a main production platform. It could also be used for launching clean out pigs to various wells and flowlines. However, it is not envisioned that the buoy be used to store or process produced hydrocarbons. Also, the buoy could be located near a drilling vessel for storing drilling mud. It could also provide power for subsea drilling equipment. Normally, the buoy is unmanned.

Further, it will also be apparent to those skilled in the art that modifications, changes and substitutions may be made to the invention in the foregoing disclosure. Accordingly, it is appropriate that the appended claims be construed broadly and in he manner consisting with the spirit and scope of the invention herein.

What is claimed is:

1. A marine buoy for the offshore support of subsea production and drilling activities, comprising:

a lower base section having a bottom surface free of openings throughout the cross-section of the lower base section;

an upper section affixed to the lower base section having a smaller cross-sectional area than the lower base section;

a deck supported by the upper section for housing equipment for operations that the marine buoy is supporting;

a chamber in the lower base section for containing equipment and/or supplies;

a vertically extending elevator shaft leading from upper section to the chamber in the lower base section; and, an elevator in the elevator shaft for transporting equipment and supplies from the deck to the chamber.

2. The marine buoy of claim 1 further comprising a solid ballast in the lower base section.

3. The marine buoy of claim 2 wherein the solid ballast is located below the lower chamber, and the solid ballast extends across the cross-section of the bottom surface and is free of openings.

4. The marine buoy of claim 1 further comprising a ballast chamber in the lower base section for selectively filling with water for ballast.

5. The marine buoy of claim 1 further comprising at least one ballast chamber in the upper section for selectively filling with water for ballast.

6. The marine buoy of claim 1 wherein the lower base section is double-walled.

7. The marine buoy of claim 1 further comprising a pump located in the lower base section for selectively filling ballast with water.

8. The marine buoy of claim 1 wherein the elevator extends from the top of the upper section.

9. The marine buoy of claim 1 further comprising a ballast located below and surrounding the lower chamber.

10. The marine buoy of claim 1 further comprising a ballast in the lower base section above the lower chamber.

11. A marine buoy for the offshore support of subsea production and drilling activities, comprising:

a cylindrical lower base section having a solid ballast and a bottom surface free of openings throughout the cross-section of the lower base section;

a cylindrical upper section connected to the lower base section with a smaller cross-sectional area than the lower base section;

a deck supported by the upper section for housing equipment for operations that the marine buoy is supporting;

a chamber in the lower base section for containing process materials;

a vertically extending elevator shaft leading from the top of the upper section to the chamber in the lower base section;

an elevator in the elevator shaft for transporting equipment and supplies from the deck to the chamber; and, a selectively filled water ballast chamber in the lower base section so that the buoy floats higher and is towable when there is no water in the ballast chamber.

12. The marine buoy of claim 11 further comprising at least one ballast chamber in the upper section for selectively filling the chamber with water as ballast.

13. The marine buoy of claim 12 wherein the ballast chamber in the lower base section for selectively filling with water is located above the lower chamber.

14. The marine buoy of claim 11 wherein the lower base section is double-walled.

15. The marine buoy of claim 11 further comprising a connector to secure a mooring line to the outside of the lower base section.

16. The marine buoy of claim 11 wherein the solid ballast is located below the lower chamber, and the solid ballast extends across the cross-section of the bottom surface and is free of openings.

17. The marine buoy of claim 11 wherein the solid ballast is located below and surrounding the lower chamber.

18. A method using a marine vessel for supporting an offshore facility involved in hydrocarbon production and for drilling, comprising:

providing a marine vessel having an upper section, a lower base section having an inner chamber, the upper section and lower base section being cylindrical, the lower base section having a greater cross-sectional dimension than the upper section;

towing the vessel to a site at a selected distance from the offshore facility;

submerging the lower base section and a portion of the upper section;

storing in the vessel material that is to be pumped into a subsea well; and delivering the stored material to the subsea well.

19. The process described in claim 18 wherein the step of storing the materials comprises storing the materials in the lower base section and in the upper section.

20. The process described in claim 19 further comprising providing a pump in the lower base section and pumping the material from the buoy vessel to the offshore facility.

21. The process described in claim 18 wherein the step of delivering the stored material to the subsea wells is performed by pumping the materials from the vessel to the subsea well.

22. The process described in claim 18 wherein the step of delivering the stored material to the subsea well is performed by pumping the material from the vessel to the offshore facility, which pumps the material to the subsea well.

* * * * *